US006422846B1

(12) United States Patent
Zhong et al.

(10) Patent No.: US 6,422,846 B1
(45) Date of Patent: Jul. 23, 2002

(54) LOW PRESSURE UNLOADER MECHANISM

(75) Inventors: Jianping Zhong, Michigan City, IN (US); Frederick L. Miller, Jr., Syracuse, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/820,604

(22) Filed: Mar. 30, 2001

(51) Int. Cl.[7] ..... F03C 4/00

(52) U.S. Cl. ..... 418/197; 418/201.2; 418/1; 418/142

(58) Field of Search ..... 418/197, 201.2, 418/1, 142

(56) References Cited

U.S. PATENT DOCUMENTS 2,481,527 A * 9/1949 Nilsson ..... 418/197
3,088,659 A * 5/1963 Nilsson et al. ..... 418/201.2
3,756,753 A * 9/1973 Persson et al. ..... 418/201.2
4,544,333 A * 10/1985 Hirano ..... 418/201.2
4,580,953 A * 4/1986 Lagerstedl et al. ..... 418/201.2
4,913,634 A * 4/1990 Nagata et al. ..... 418/201.2
5,807,091 A * 9/1998 Shaw ..... 418/197
5,911,743 A * 6/1999 Shaw ..... 418/97

* cited by examiner

*Primary Examiner*—Thomas Denion
*Assistant Examiner*—Theresa Trieu

(57) ABSTRACT

Two slide valves are located in the discharge end bearing case of a multi-rotor screw machine and independently coact with the sun rotor of the multi-rotor screw machine for controlling capacity and $V_i$. Movement of the slide valves is in a plane perpendicular to the axis of the sun rotor.

5 Claims, 12 Drawing Sheets

LOW PRESSURE UNLOADER MECHANISM

BACKGROUND OF THE INVENTION

In twin screw compressors there is a nominal maximum of 360° of the helical groove or flute volume of each rotor that is trapped and compressed by the coacting rotors. Because the bores for the rotors overlap, the actual maximum helical groove or flute volume attainable for each rotor is more on the order of 330°. The overlapping bores create cusps in the nature of the waist of a figure eight. One of the cusps is the normal location for an unloader which moves axially in the cusp to unload and to control the $V_i$, or discharge pressure to suction pressure ratio, of the compressor. In one conventional unloading scheme, the unloader is normally exposed to both suction pressure and discharge pressure and as is acted upon by the difference in pressure which is driven by the solenoids. The axial movement of the unloader permits the use of axial porting which generally permits a larger port area and greater efficiency.

In the case of a tri-rotor, screw machine, the sun rotor has about 150° of helical flute volume compression with each of the coacting rotors and about 30° of overlap with each coacting rotor. The sun rotor is larger than the driven rotors such that the cusps formed by overlapping bores are asymmetrical. Forces tend to be large and require a large driving mechanism. This coupled with the short rotor length of the compression process make conventional unloader structure complicated and difficult to use.

SUMMARY OF THE INVENTION

The slide valves move in a plane perpendicular to the axis of rotation of the sun rotor and coact only with the sun rotor. The slide valves are located in the compressor discharge end bearing case such that the slide valve bodies are part of the end surface of the discharge end bearing case facing and sealing with the rotors. In the fully loaded position, the valve edge on the high pressure side of the slider of each slide valve defines part of an outlet port and is machined to the shape of the male, sun rotor profile and the desired full load $V_i$. The valve edge on the low pressure side of each slider is machined to a shape matching the male rotor profile or it may just be straight. When the slide valves are fully closed, the full load $V_i$ is controlled by the male rotor axial porting which is controlled by the valve design of the high pressure side. The male and female rotor radial porting, as well as the female rotor axial porting, are designed to the same $V_i$ which is designed to meet the lowest loading condition.

As a slide valve closes, it reduces the axial discharge port size and retards the start of compression by uncovering flutes thereby unloading refrigerant gas back to suction. The gas passing back to suction goes through the sun rotor which has a plurality of circumferentially spaced axial bores located radially inward of the root circle. The slide valve actuators are located in low pressure cavities such that only a small cross section of the slide valves see high pressure, therefore only a small force needs to be overcome by the slide valve actuators.

It is an object of this invention to provide a method and apparatus for unloading and $V_i$ control for a multi-rotor screw compressor.

It is another object of this invention to provide a slide valve requiring a relatively low actuating force.

It is a further object of this invention to reduce the size of the actuator required and the sealing requirements in slide valves for a multi-rotor compressor. These objects, and others as will become apparent hereinafter, are accomplished by the present invention.

Basically two slide valves are located in the discharge end bearing case of a multi-rotor screw machine and independently coact with the sun rotor of the multi-rotor screw machine for controlling capacity and $V_i$. Movement of the slide valves is in a plane perpendicular to the axis of the sun rotor.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
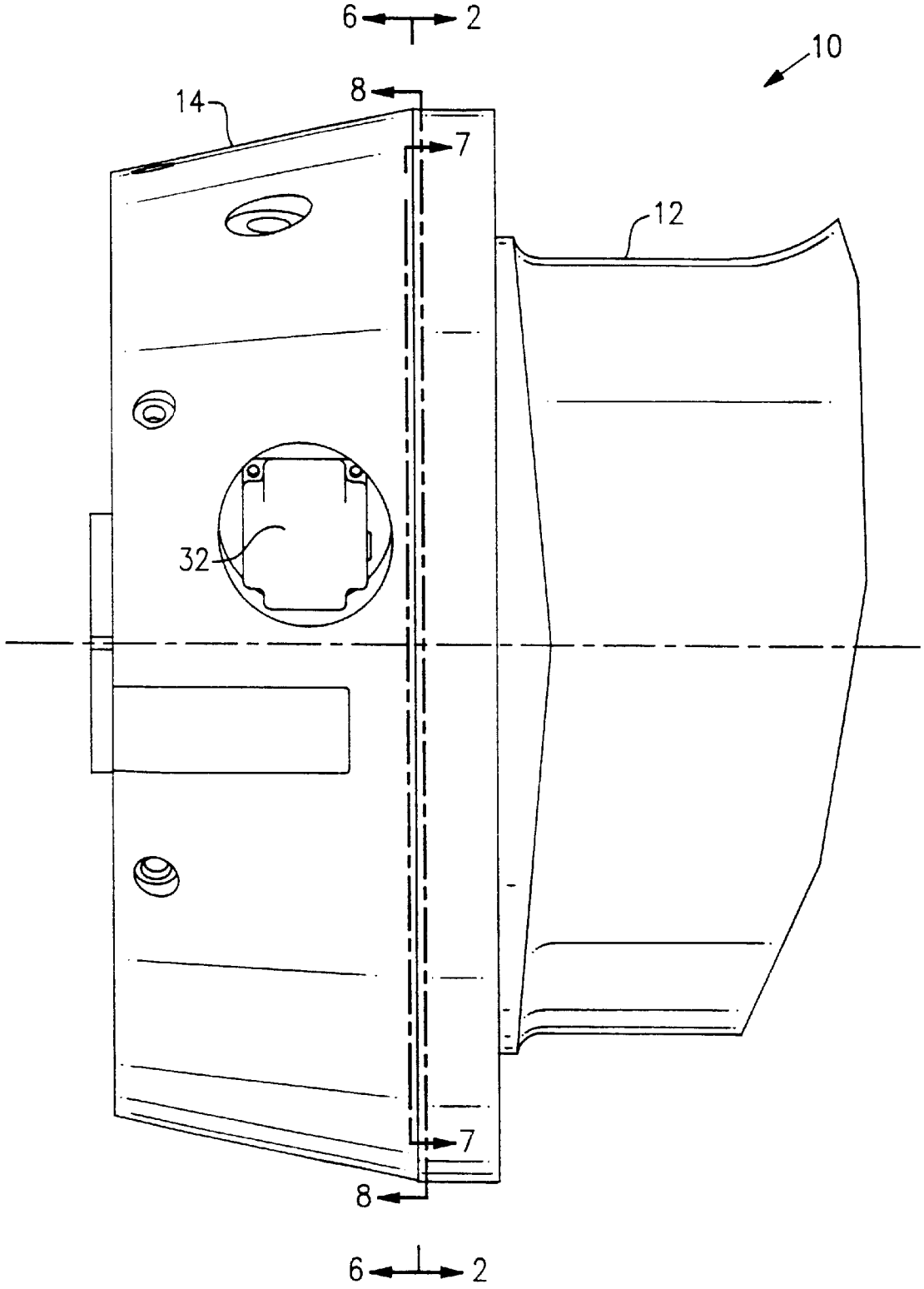
FIG. 1 shows a portion of the discharge end of a tri-rotor compressor.

In a number of the figures the views show chambers and cavities that, during operation, are filled with gas at varying pressures. Where the chamber or cavity structure is unhatched, the pressure of the gas has been indicated by stippling. No stippling has been placed on structure in the chambers or cavities. Suction, intermediate and discharge pressures are the only pressures indicated. The greater the density of the stippling, the greater the pressure being represented.

In FIGS. 1–3 and 6–15, the numeral 10 generally designates a multi-rotor screw machine with a three-rotor screw compressor being illustrated. Screw compressor 10 includes rotor case 12 and discharge end bearing case 14. Referring specifically to FIG. 2 which is taken along line 2—2 of FIG. 1, rotor case 12 has overlapping bores 12-1, 12-2 and 12-3 which have parallel axes and which receive rotors 20, 21 and 22, respectively, which are coaxial therewith. The parallel axes of bores 12-1, 12-2 and 12-3 and their rotors 20, 21 and 22, respectively, are designated by points A, B and C, respectively, and would normally be in the same plane in a tri-rotor screw machine in order to balance forces and output. Where more than three rotors are employed, the rotors would normally be uniformly spaced relative to the sun rotor. Rotor 21 is a male, sun rotor which has a plurality of lands or lobes 21-3 and intervening flutes 21-4 which coact with and drive female rotors 20 and 22. Radial discharge port 12-4 is formed in one of the cusps between bores 12-1 and 12-2. Similarly radial discharge port 12-5 is formed in one of the cusps between bores 12-2 and 12-3 at a location diametrically opposite radial discharge port 12-4 relative to rotor 21. A labyrinth seal 21-1 is formed on the discharge end of male, sun rotor 21 just inside the root circle and seals with the discharge end bearing case 14 and the identical slide valves 30 and 40. The labyrinth seal 21-1, or other suitable seal, may be integral with rotor 21 or may be a separate piece. The seal 21-1 extends axially outward from rotor 21 such that a cavity 16 is formed radially inward of seal 21-1. A plurality of axially extending bores 21-2 extend through rotor 21 and provide fluid communication between suction of compressor 10 and the chamber 16 formed by labyrinth seal 21-1 coacting with discharge end bearing case 14 and slide valves 30 and 40.

Figure 2:
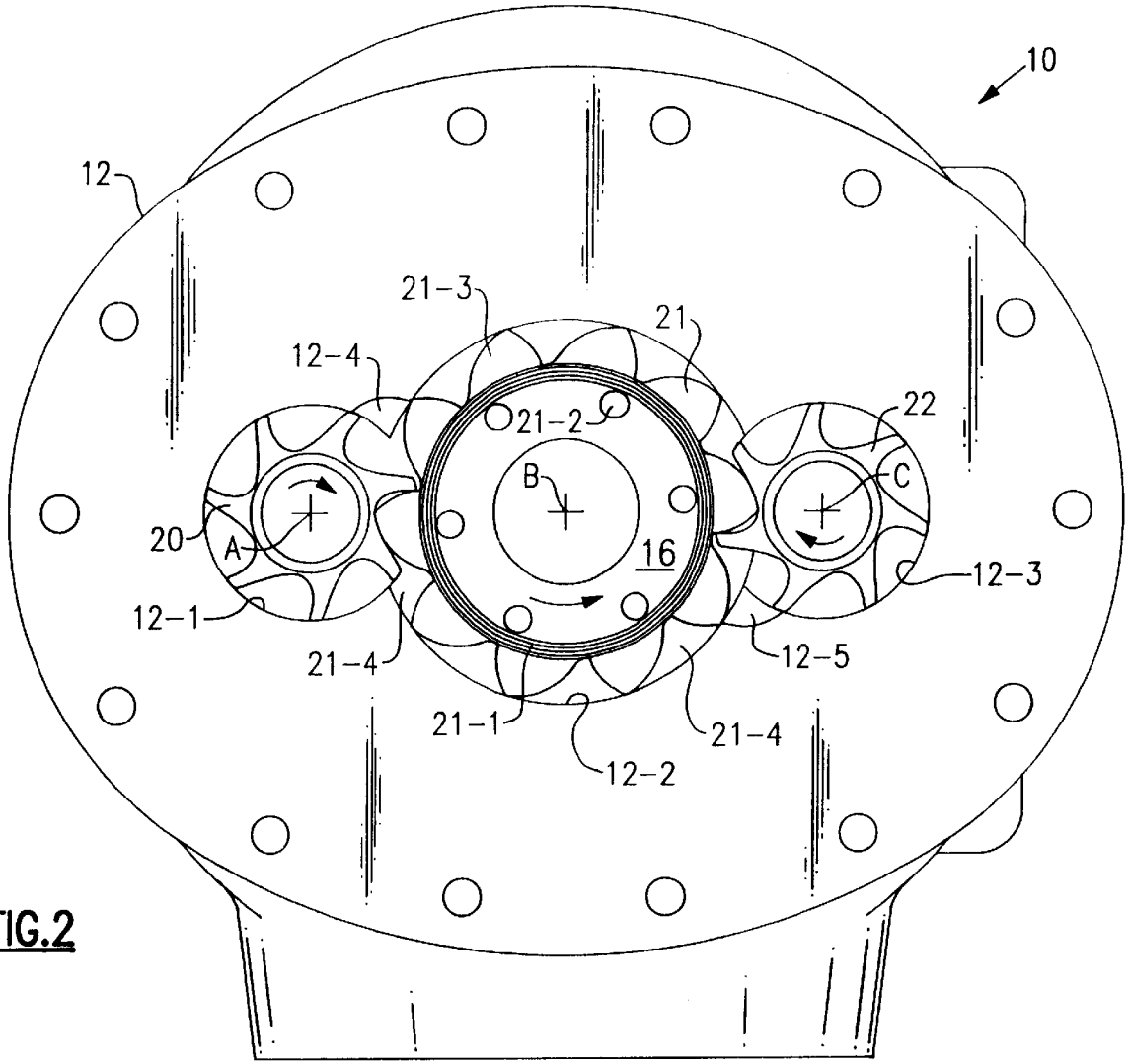
FIG. 2 is a view taken along line 2—2 of FIG. 1 and is a discharge end view of the rotors of a multi-rotor screw machine.
Figure 3:
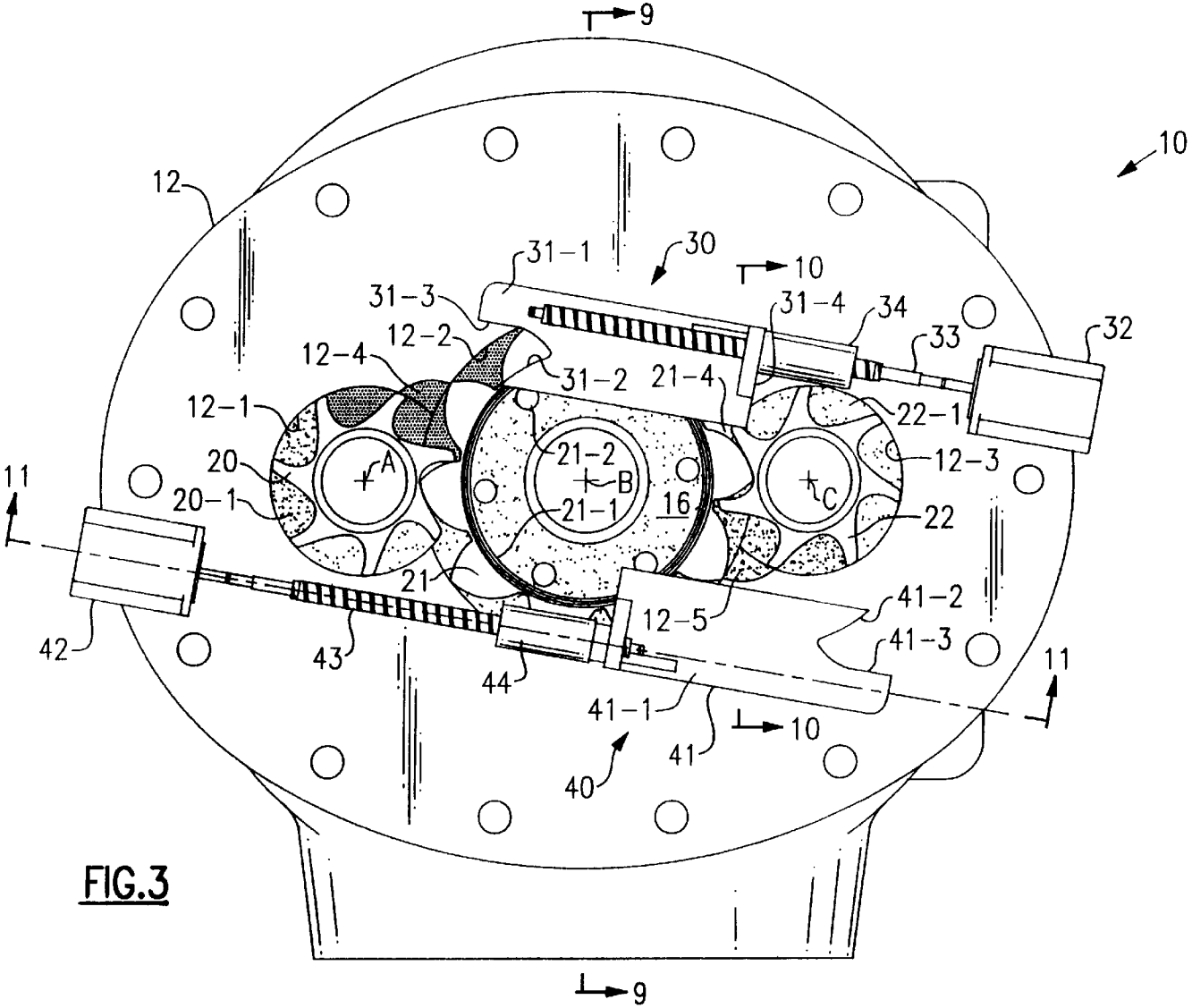
FIG. 3 corresponds to FIG. 2 with the slide valves added and showing the two extreme positions of the slide valves.
Figure 4:
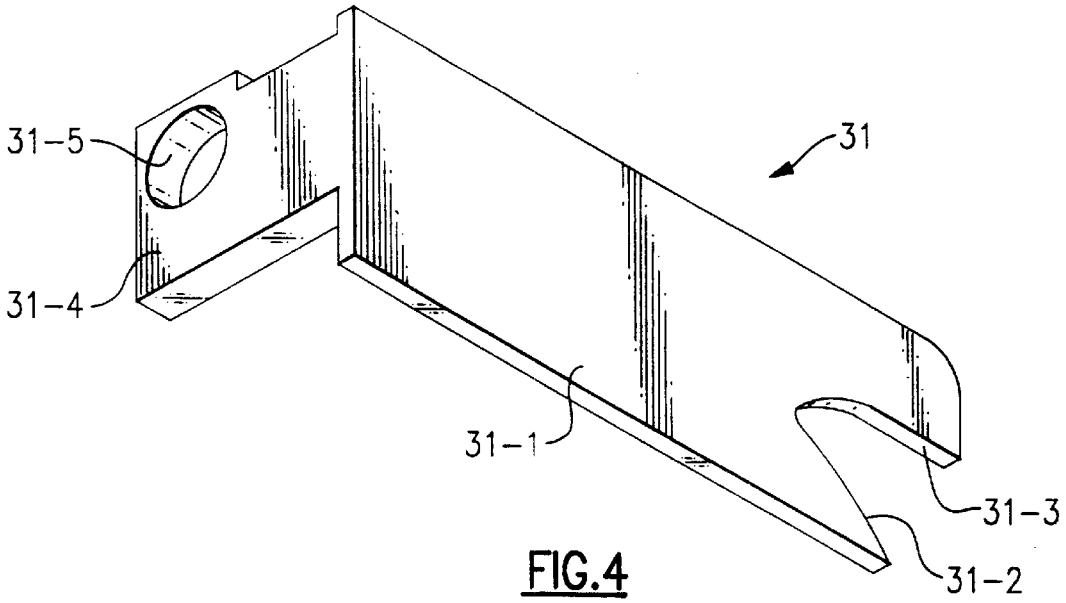
FIG. 4 is a pictorial view of the slider of a slide valve.
Figure 5:
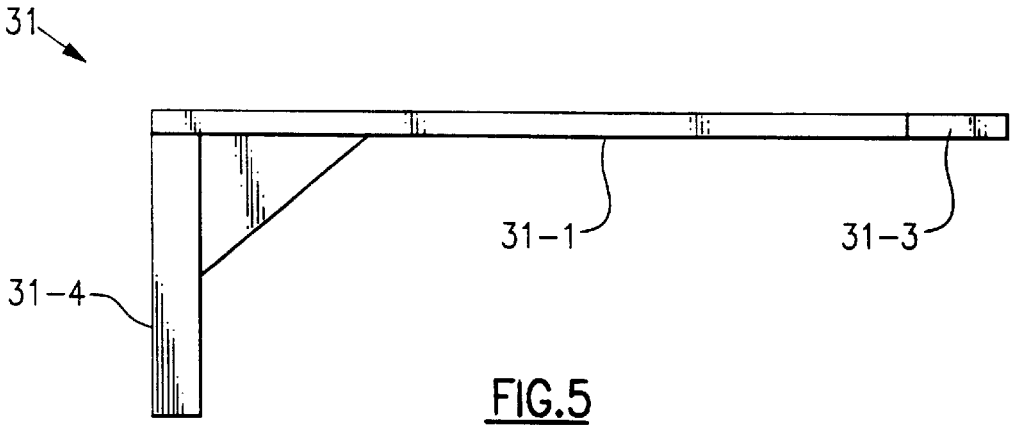
FIG. 5 is a side view of the slider of a slide valve.

FIG. 3 differs from FIG. 2 by the addition of identical slide valves 30 and 40 and the indication of pressures by stippling. Slider 31 of slide valve 30 is illustrated in an extreme position corresponding to full load whereas slider 41 of slide valve 40 is illustrated in another extreme position corresponding to the lowest amount of compression which would be on the order of 10% to 25% of full load. While sliders 31 and 41 can be moved into the illustrated opposite extreme positions, this would normally not be the case due to the unbalance it produces between the rotors. In FIGS. 4 and 5 the slider is labeled 31 but slider 41 would be identical. Taking FIGS. 3–5 together it will be noted that slider 31 has a valve portion 31-1 which reciprocates in a cavity in the nature of a piston and has an edge defined by a notch or cutout which, in the illustrated position of FIG. 3, has a first portion 31-2 located just radially outward of labyrinth seal 21-1 and a second portion 31-3 corresponding to a portion of the profile of the rotor flute 21-4 of underlying rotor 21. Notch portions 31-2 and 31-3 are for axial $V_i$ to control porting and are in the full load position in FIG. 3. Slider 31 includes leg portion 31-4 having a bore 31-5 extending therethrough. Radial discharge ports 12-4 and 12-5 are machined to small port sizes. Typically, small axial ports are found in radially unloaded twin screw compressors. So, compressor 10, by employing axial unloading, is the opposite of the traditional approach. This radial flow does not get blocked off in any positions of sliders 31 and 41. Thus, sliders 31 and 41 do not affect radial flow through ports 12-4 and 12-5. As illustrated, the pressure at port 12-4 is full discharge pressure because slider 31 is in the full load position. Port 12-5 is at an intermediate pressure because slider 41 is in the lowest compression position. The axial discharge port defined by portions 31-2 and 31-3 of slider 31, in the illustrated position, is set to the largest opening required by the design capabilities required of compressor 10. This is also true of notch portions 41-2 and 41-3 of valve portion 41-1 when slider 41 is in a position corresponding to the illustrated position of slider 31. In the illustrated position, slider 31 completes a seal with underlying labyrinth seal 21-1 and seals underlying flutes 21-4 permitting compression to take place therein. Slider 31 is placed in position by stepper motor 32 which holds slider 31 in position against fluid pressure forces acting on slider 31. The fluid pressure forces are small because they only act on notch surfaces 31-2 and 31-3 of slider 31 and notch surfaces 41-2 and 41-3 of slider 41. Stepper motors 32 and 42 are low voltage controlled and are activated responsive to sensed conditions under the control of microprocessor 60 which responds to the sensed conditions.

Figure 6:
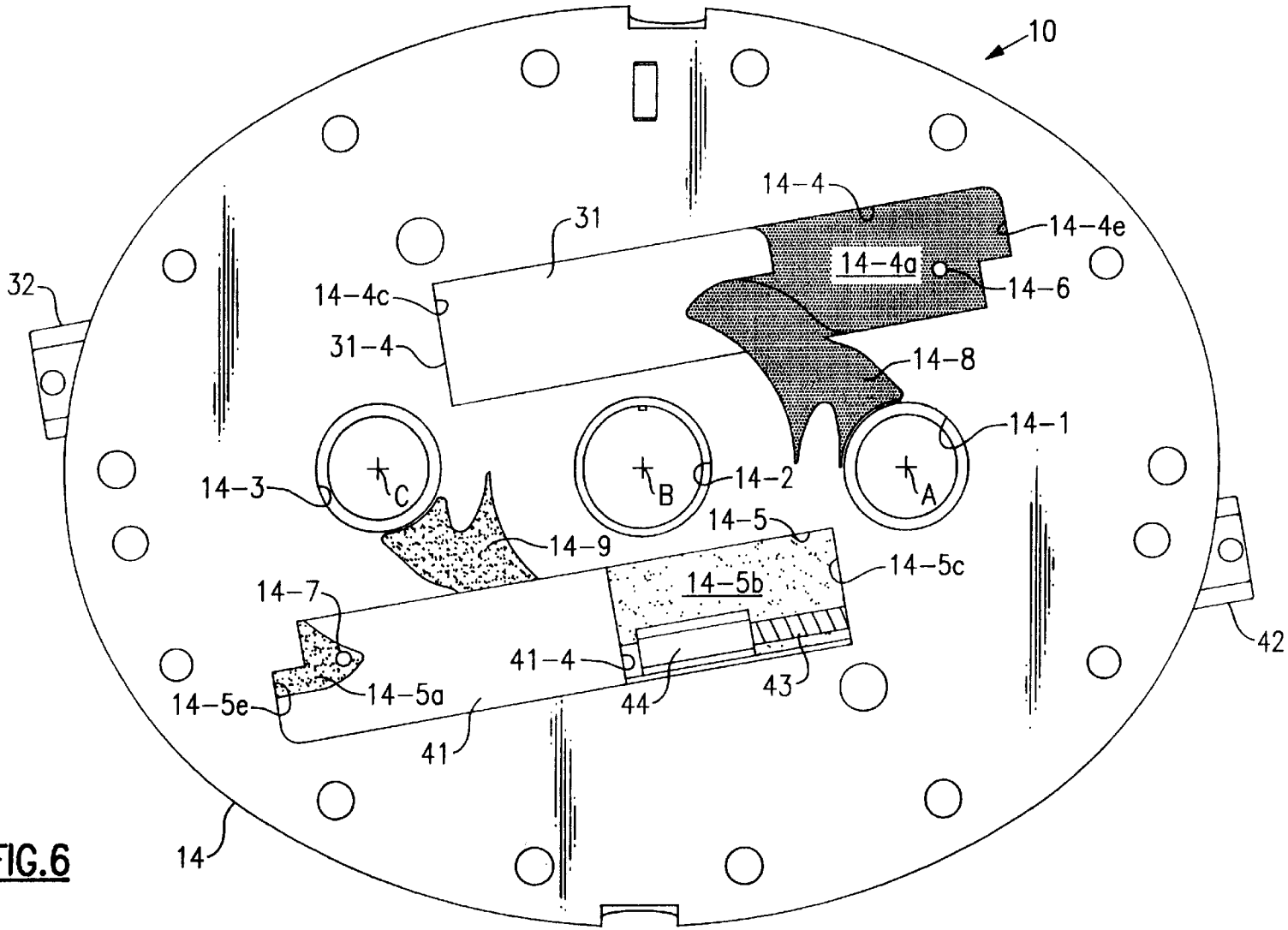
FIG. 6 is a view taken along line 6—6 of FIG. 1 and is a suction side view of the discharge end bearing case with the slide valves in their FIG. 3 positions.

FIG. 6 is taken along line 6—6 of FIG. 1 and illustrates the structure overlying and sealing with the structure of FIG. 2. Discharge end bearing case 14 has bores 14-1, 14-2 and 14-3, respectively, formed therein for receiving the discharge ends and supporting the bearings of rotors 20, 21 and 22, respectively. Bores 14-1, 14-2 and 14-3 are coaxial with bores 12-1, 12-2 and 12-3, respectively, and therefore have common axes A, B and C, respectively, which are commonly labeled. Stepped recesses 14-4 and 14-5 are formed in discharge end bearing case 14 and receive sliders 31 and 41, respectively, so as to permit, guide and limit the movement of sliders 31 and 41 by stepper motors 32 and 42, respectively. Slider 31 coacts with rotor case 12 and rotor 21 to divide recess 14-4 into chamber 14-4*a* which is at discharge pressure and chamber 14-4*b* which is at suction pressure, and beneath slider 31, in the illustrated position of FIG. 6. Similarly, slider 41 coacts with rotor case 12 and rotor 21 to divide recess 14-5 into chamber 14-5*a* which is at intermediate pressure and chamber 14-5*b* which is at suction pressure in the illustrated position of FIG. 6. Attention is specifically directed to FIG. 12 which is believed to present the clearest showing of chambers 14-5*a* and 14-5*b*. Slider 41 is in an intermediate position with leg portion 41-4 spaced from end wall 14-5*c* and step 14-5*d* which coact with leg portion 41-4 to define the extreme limits of travel for slider 41. Step 14-5*d* marks one boundary of chamber 14-5*b*. At least a portion of valve portion 41-1 extends between step 14-5*d* and end wall 14-5*e* in a fluid tight relationship due to precision machining, oil sealing and/or suitable mechanical seals such as 45. Chamber 14-5*a* is located between the end of valve portion 41-1 and end wall 14-5*e* of recess 14-5. The structure of recess 14-4 and chambers 14-4*a* and 14-4*b* would be the same as that of recess 14-5 and chambers 14-5*a* and 14-5*b* and includes end walls 14-4*c* and 14-4*e* which appear in FIG. 6.

As illustrated in FIG. 6, leg 31-4 is against end wall 14-4*c* of recess 14-4. This effectively closes off any suction bypass by covering the maximum number of flutes 21-4 and gives full discharge pressure. The same would be true when leg 41-4 of slider 41 is against end 14-5*c* of recess 14-5. Leg 41-4 of slider 41, in the illustrated position, is spaced from end 14-5*c* of chamber 14-5*b* such that the least coverage of flutes 21-4 takes place and recess 14-5*b* is exposed to suction pressure. Relief bores 14-6 and 14-7 extend from chambers 14-4*a* and 14-5*a*, respectively, to axial discharges 14-8 and 14-9, respectively, to permit the escape of gas from chambers 14-4*a* and 14-5*a* as sliders 31 and 41 reciprocate, respectively, therein.

Figure 7:
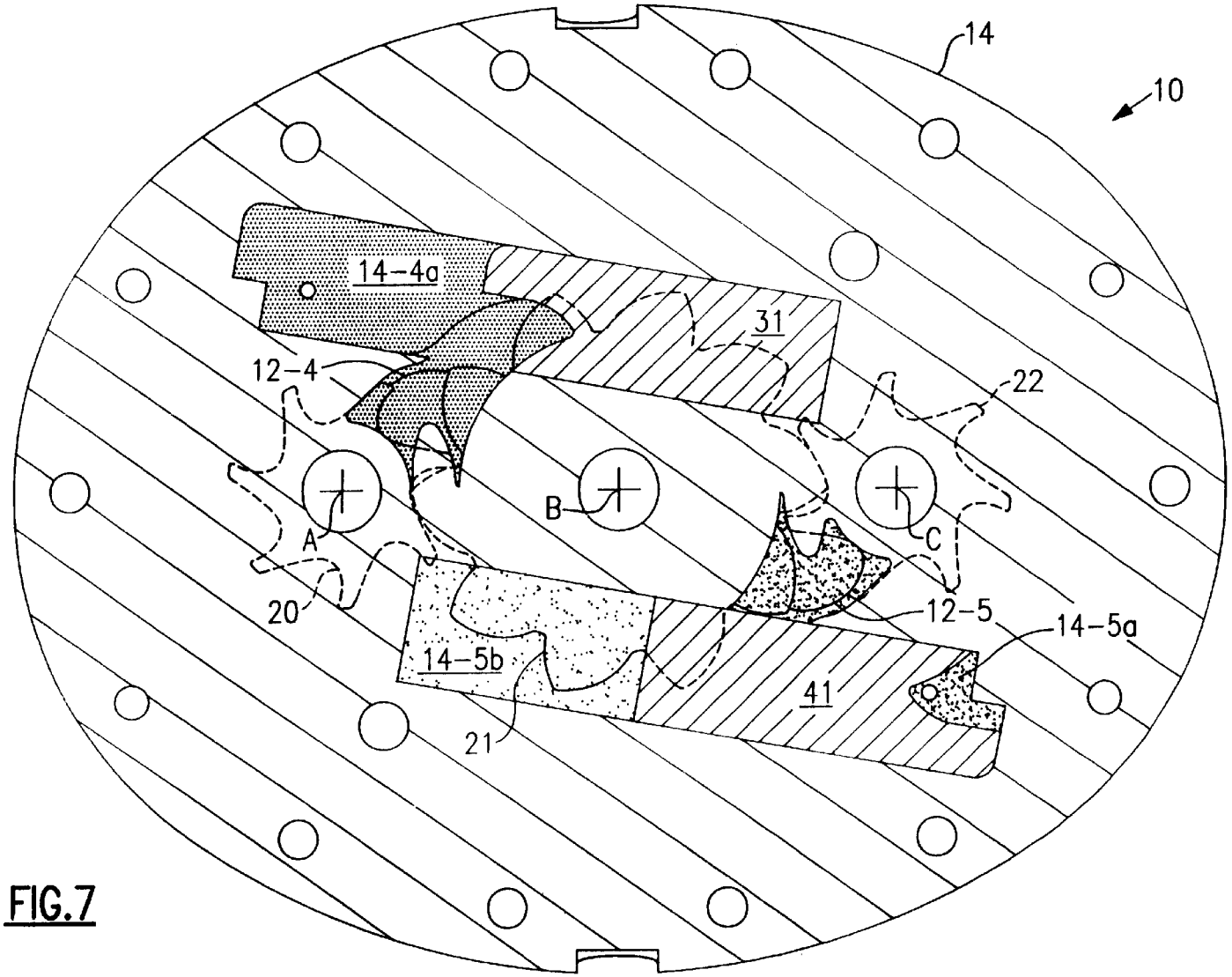
FIG. 7 is a sectional view taken along line 7—7 of FIGS. 1 and 10.
Figure 8:
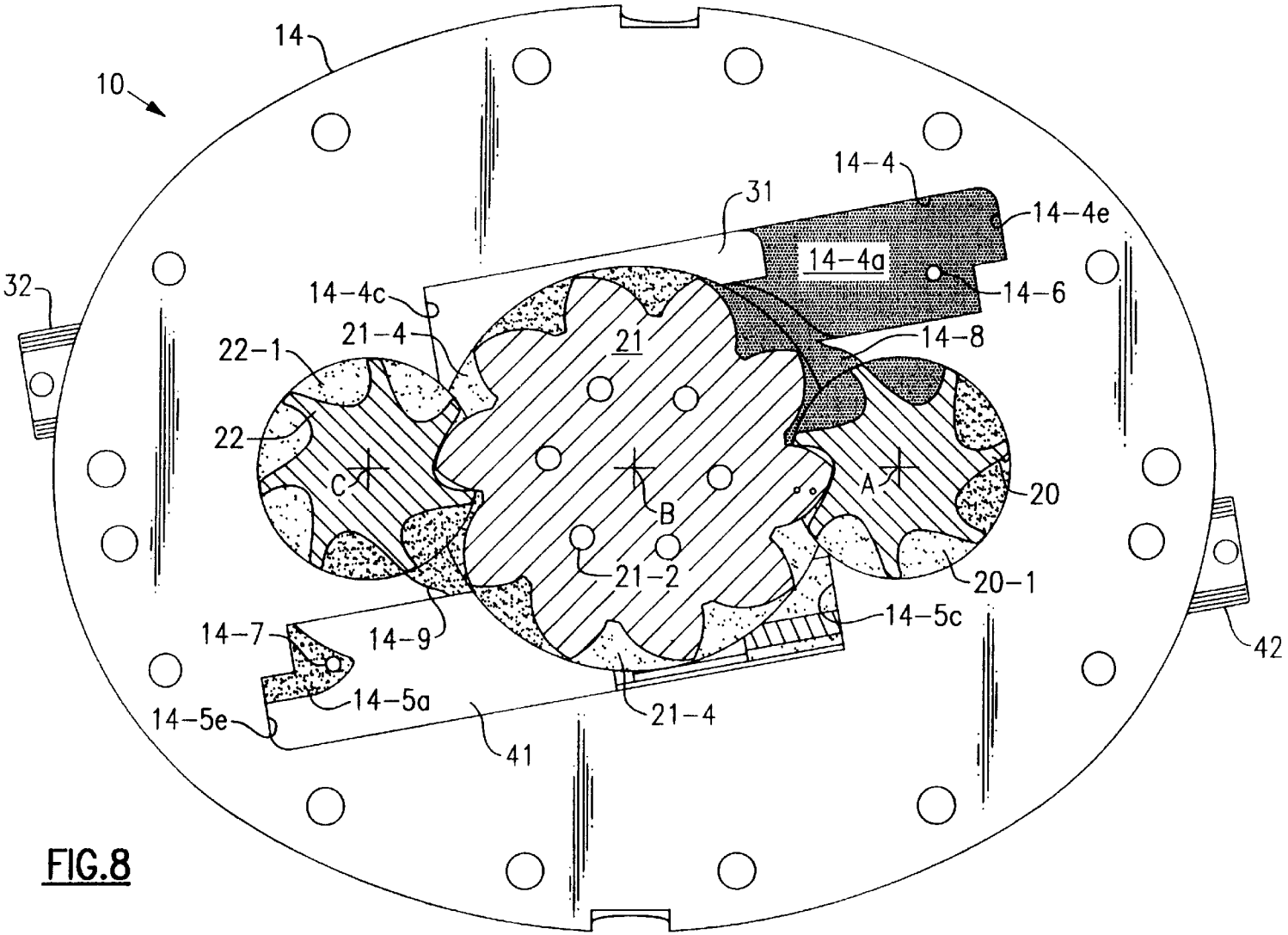
FIG. 8 corresponds to FIG. 6 with a section of the rotors taken along line 8—8 of FIG. 1 added.

FIG. 7 is a section taken along line 7—7 of FIGS. 1 and 10 and is just below the surface of FIG. 6, but looking in the opposite direction. Where rotors 20, 21 and 22 are not visible in the view, they are shown in phantom so that the coaction of slider 31 with radial discharge port 12-4, axial discharge 12-8 and rotors 20 and 21 is clearly shown. Similarly the coaction of slider 41 with radial discharge port 12-5, axial discharge 14-9 and rotors 21 and 22 is clearly shown. FIG. 8 is the same as FIG. 6 except that thin sections of rotors 20, 21 and 22, corresponding to line 8—8 of FIG.

1 have been placed in their operating positions relative to discharge end bearing case 14.

Figure 9:
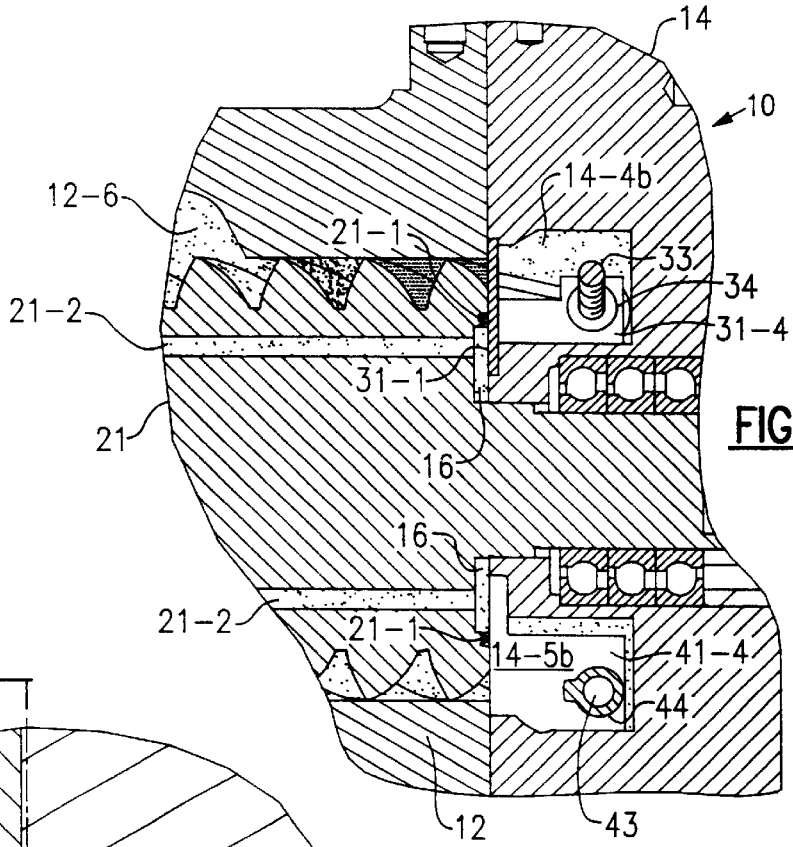
FIG. 9 is a partial cross sectional view taken along a line corresponding to line 9—9 of FIG. 3.
Figure 10:
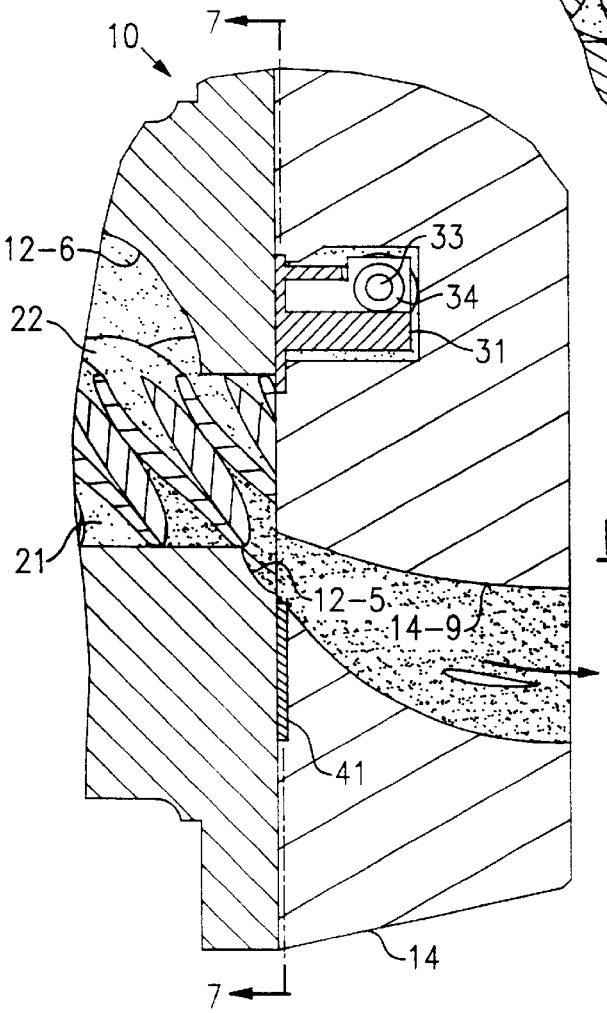
FIG. 10 is a partial cross sectional view taken along a line corresponding to line 10—10 of FIG. 3.

FIGS. 9 and 10 show the relationship of the slide valves 30 and 40 to the rotor 21 when the sliders 31 and 41 are in their FIG. 3 positions. Referring specifically to FIG. 9 it will be noted that valve portion 31-1 of slider 31 seals with labyrinth seal 21-1 and forms a portion of chamber 16 and prevents chamber 14-4*b* from communicating with chamber 16. Slider 41 is not in full registry with labyrinth seal 21-1 and fluid communication can take place between chamber 14-5*b* and chamber 16. It will be noted that both chamber 14-4*b* and chamber 14-5*b* are at suction pressure independent of the position of sliders 31 and 41. Chambers 14-4*b* and 14-5*b* provide a flow path for suction bypass when they are not in a full sealing position with respect to labyrinth seal 21-1. So, as illustrated in FIG. 9, chamber 14-5*b* is in fluid communication with chamber 16 and bores 21-2 to permit the bypassing of pressurized fluid from rotors 21 and 22 back to suction. Referring specifically to FIG. 10, the meshing rotors 22 and 21 are illustrated. Gas is drawn from suction chamber 12-6 and compressed gas discharges via radial discharge 12-5 and axial discharge 14-9. Although suction chamber 12-6 is illustrated as being a short axial distance from radial discharge port 12-5, they are over, 180° apart in the compression cycle.

Figure 11:
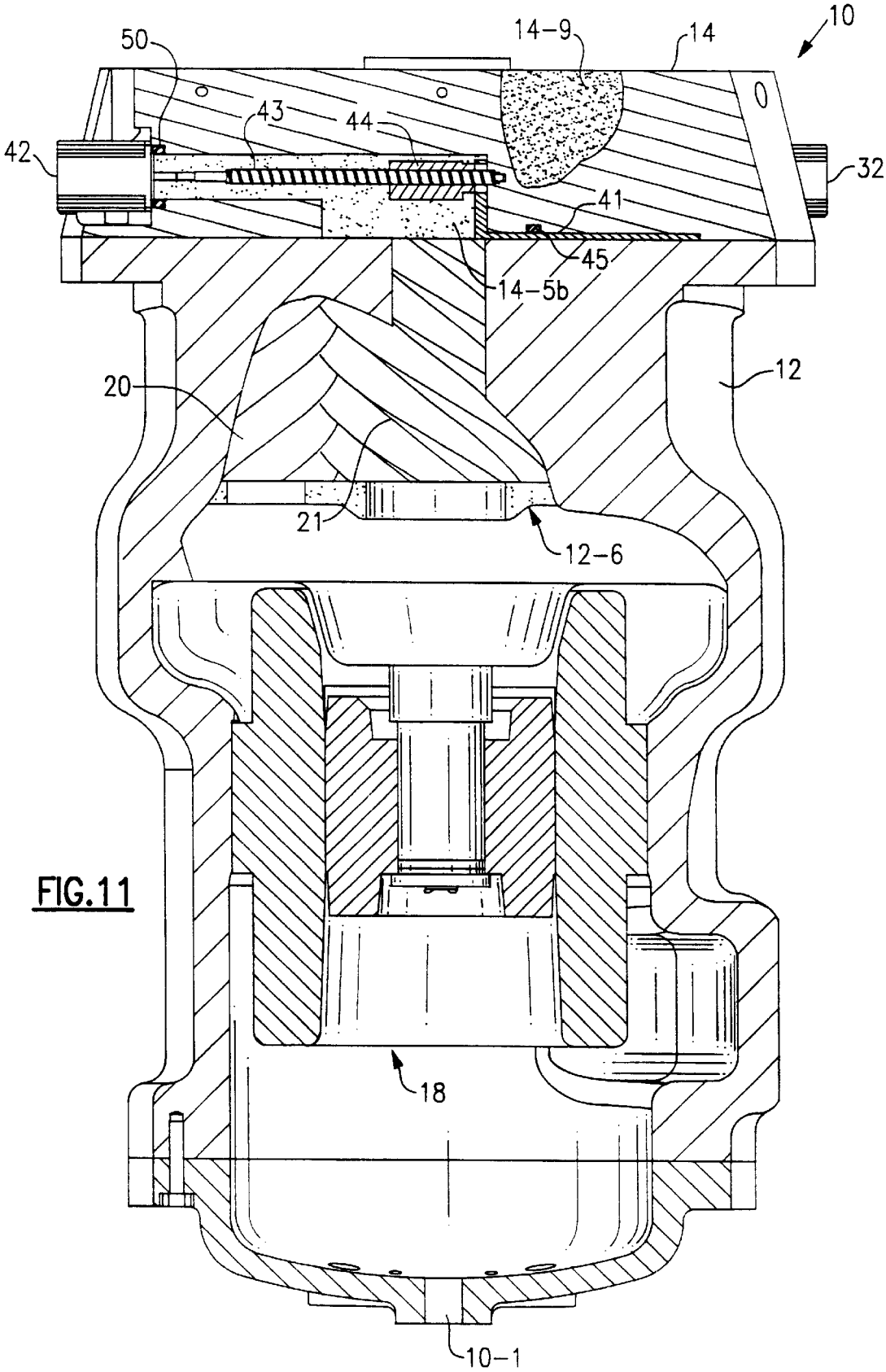
FIG. 11 is a partially cutaway sectioned view taken along a line corresponding to line 11—11 of FIG. 3.
Figure 12:
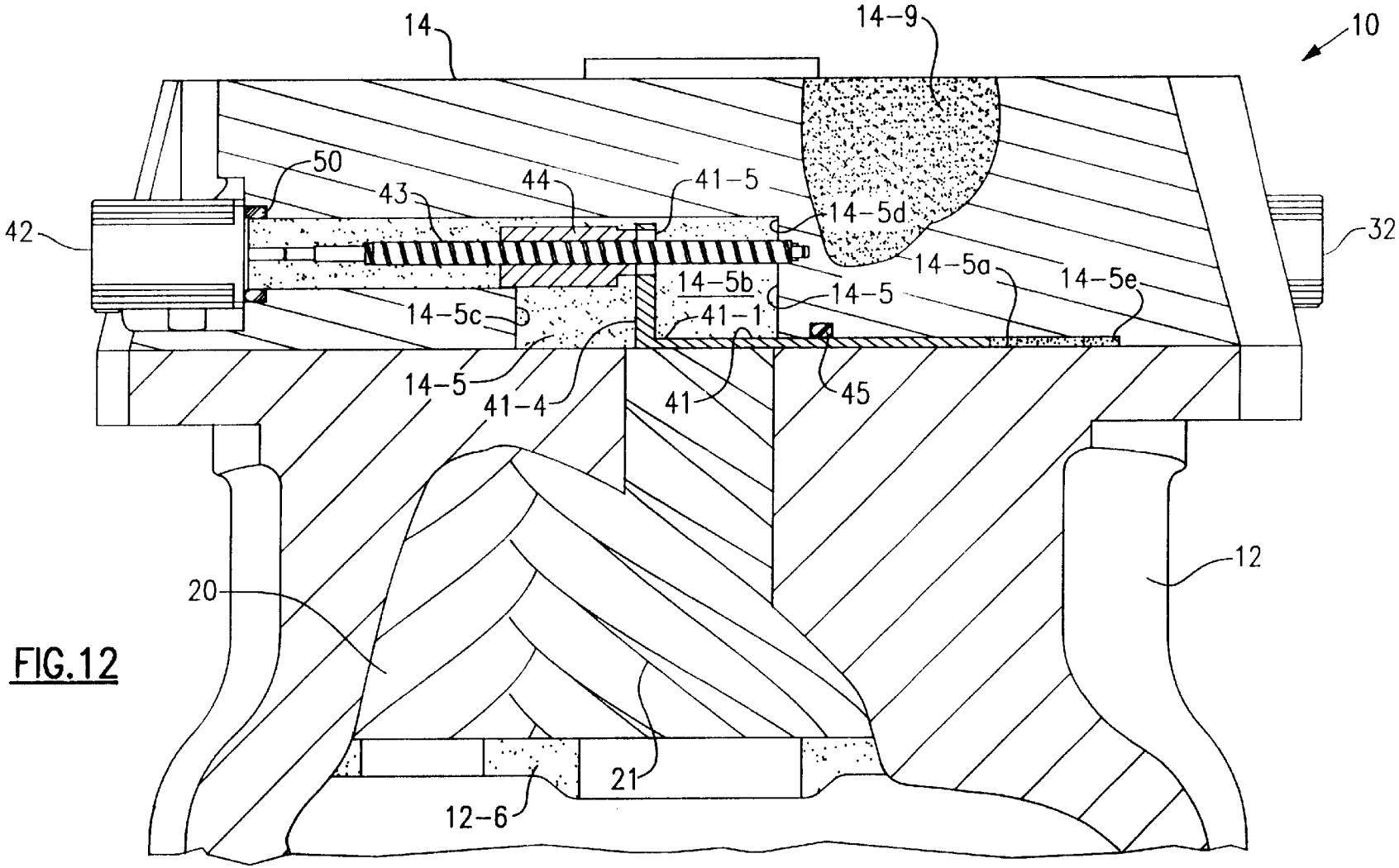
FIG. 12 is an enlarged view of a portion of FIG. 11 with the slider of the slide valve repositioned to an intermediate position.

FIGS. 11 and 12 are specific to slide valve 40 but the corresponding structure and relationships exist for slide valve 30. Although rotors 20 and 21 are illustrated, as is clear from FIGS. 3, 7 and 8, there is no direct coaction between slide valves 30 or 40 with either rotor 20 or 22. When flutes 21-4 are covered and uncovered by sliders 31 and 41, there is a coaction with rotors 20 and 22 in the sense that flutes 21-4 are in fluid communication with corresponding flutes 20-1 and 22-1 which would be similarly affected by sliders 31 and 41. FIG. 12 illustrates slider 41 at an intermediate position to that of sliders 31 and 41 in FIG. 3 relative to covering flutes 21-4 such that slider 41 does not have full sealing with labyrinth seal 21-1. The chamber 14-5*b* in which the leg 41-4 of slide 41 reciprocates is at suction pressure since it is in free communication with chamber 16. The other end of slide 41 coacts with the portions of rotor case 12 and discharge end bearing case 14 forming and sealing chamber 14-5*a* to prevent fluid communication with chamber 16. If necessary or desirable, a suitable seal 45 may be provided to coact with slide 41 to seal chamber 14-5*a* from chamber 14-5*b*.

Stepper motors 32 and 42 are suitably attached to discharge end bearing case 14, as best shown in FIGS. 1, 11 and 12. The stepper motor shafts are suitably sealed, as by O-rings 50, between the stepper motor housings and discharge end bearing case 14. Sliders 31 and 41 are in the discharge end bearing case 14 also, but are at the discharge end face of rotor 21 and coact with labyrinth seal 21-1. When stepper motors 32 and 42 are energized, they turn the stepper motor screws 33 and 43, respectively, that run through the ball bearings 34 and 44, respectively, that are suitably attached to legs 31-4 and 41-4 of sliders 31 and 41, respectively, as well as through bores 31-5 and 41-5, respectively. This causes the sliders 31 and 41 to move. Stepper motors 32 and 42 can stop at any desired position to regulate the capacity of compressor 10, as required. Stepper motors 32 and 42 can be operated independently of each other to produce a variable amount of unloading for compressor 10.

Figure 13:
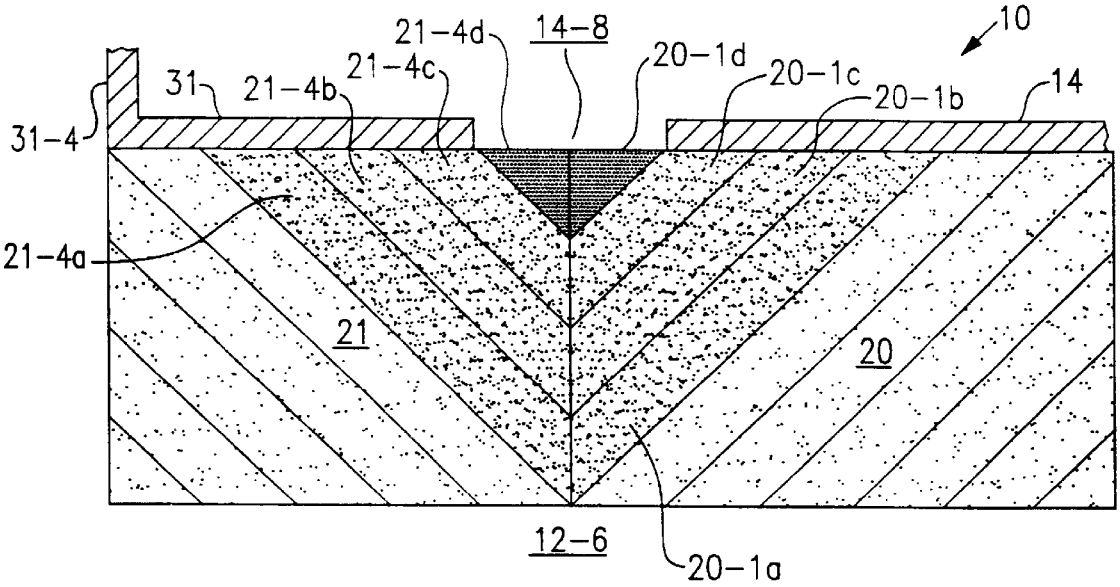
FIG. 13 is an unwrapped view of a pair of rotors with the slide valve in the full load position.

FIG. 13 illustrates slider 31 in its full load position of FIG. 3 relative to unwrapped rotors 20 and 21. The lands and flutes of rotors 20 and 21 engage and seal to provide chevron shaped trapped volumes which are sealed by slider 31 and discharge end bearing case 14 coacting with rotor 20. The first closed volume is defined by flute 21-4*a* of rotor 21 and flute 20-1*a* of rotor 20 and represents the first closed volume at the start of the compression cycle. The closed volume defined by flutes 21-4*b* and 20-1*b* represents a further step in the compression cycle. Flutes 21-4*c* and 20-1*c* define the last closed volume which has a restricted communication with discharge 14-8 permitting further compression until flutes 21-4*d* and 20-1*d* freely communicate with discharge 14-8.

Figure 14:
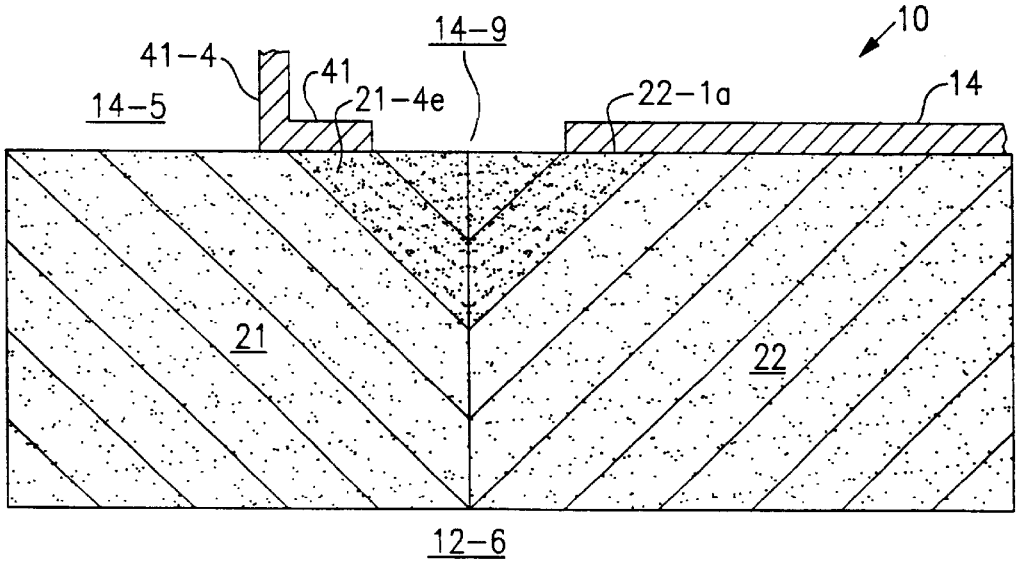
FIG. 14 is an unwrapped view of a pair of rotors with the slide valve in the least load position.

FIG. 14 illustrates slider 41 in its least loaded position of FIG. 3 relative to unwrapped rotors 21 and 22. The lands and flutes of rotors 21 and 22 engage and seal to provide chevron shaped trapped volumes which are sealed by slider 41 and discharge end bearing case 14. Due to the position of slider 41, only one flute on rotor 21 is sealed so that flutes 21-4*e* and 22-1*a* define both the first and last closed lobe and deliver the compressed gas to discharge 14-9 at an intermediate pressure.

Figure 15:
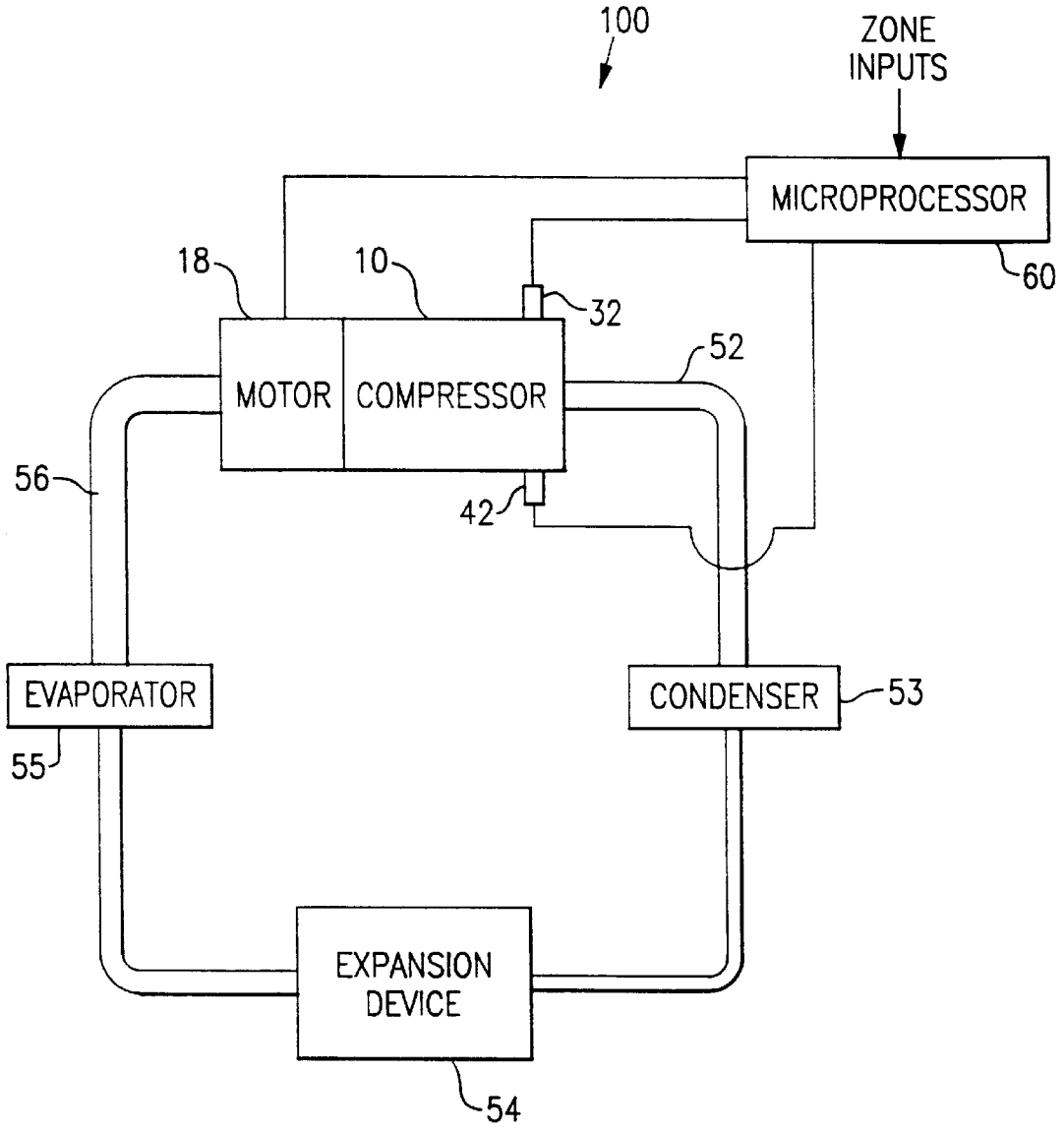
FIG. 15 is a schematic representation of a refrigeration system employing the compressor of the present invention.

FIG. 15 is a schematic representation of a refrigeration system 100 employing compressor 10 of the present invention. Taking FIGS. 11 and 15 together, in the operation of refrigeration system 100, gaseous refrigerant is drawn into compressor 10 from suction line 56 via suction inlet 10-1, passes over motor 18, through suction chamber 12-6 into the rotors 20, 21 and 22 and is compressed. The resultant hot, high pressure refrigerant gas is supplied via discharge line 52 to condenser 53. In condenser 53, the gaseous refrigerant condenses and gives up heat due to heat transfer via air, water or brine-cooled heat exchangers (not illustrated). The condensed refrigerant passes through expansion device 54 thereby undergoing a pressure drop and partially flashing as it passes into evaporator 55. In evaporator 55, the remaining liquid refrigerant evaporates due to heat transfer via air, water or brine cooled heat exchangers (not illustrated). The gaseous refrigerant is then supplied via suction line 56 to compressor 10 to complete the cycle. During operation, capacity is controlled by microprocessor 60, responsive to zone inputs, by controlling compressor 10 via stepper motors 32 and 42.

Starting with its illustrated position of FIGS. 3, 6, 7, 8 and 13 which represents an extreme position of slider 31, representing full load, slider 31 seals with labyrinth seal 21-1 to prevent fluid communication between chambers 14-4*b* and 16 and covers the maximum number of flutes 21-4, as shown in FIG. 13, to permit compression of the gas therein. The portion of slider 31 located radially outward of labyrinth seal 21-1 is acted on by discharge pressure and the pressure in the underlying flutes 21-4 and forced into contact with discharge end bearing case 14 between step 14-4*d* and end 14-4*e* (This is best shown in FIG. 12 with respect to slider 41 which is pushed against discharge end bearing case 14 and seal 45 between step 14-5*d* and end 14-5*e*). As stepper motor 32 is energized by microprocessor 60, screw 33 turns and slider 31 moves towards the left in FIGS. 3, 7 and 13 and towards the right in FIGS. 6 and 8. At the first movement of slider 31, the axial discharge partially defined by notch portions 31-2 and 31-3 changes position and starts to cut down the size of the axial discharge 14-8. As slider 31 moves from its position of FIGS. 3, 6, 7 and 12, it permits fluid communication between chamber 14-4*b* and chamber 16 which communicates with suction chamber 12-6 via bores 21-2, as is best seen in FIG. 9. This unloads the compressor 10 to the extent that flow is permitted between chambers 14-4*b* and 16. At the same time, the end defined by leg 31-4 of slider 31 opens to suction, as best shown in FIG. 13, and uncovers flutes 21-4 to some degree. This delays the start of the compression cycle due to an axial relief. The relief flow is from uncovered flutes 21-4 on rotor 21, to the extent that the flutes 21-4 are pressurized, across axial labyrinth seal 21-1 via recess 14-4*b* into chamber 16 and back to suction chamber 12-6 through the vent holes defined by bores 21-2. It should be noted that, in traditional axial slide valve unloaders, this same type of delayed compression occurs, but it is done in the radial direction.

As stepper motor 32 continues to turn screw 33, slider 31 continues to move further from its FIG. 3 position, the axial discharge defined in part by notch portions 31-2 and 31-3 goes outside of the bore 12-2 of male, sun rotor 21. Once this has occurred, the discharge port defined in part by notch portions 31-2 and 31-3 is not in operation. At this point, the size of the discharge port does not change with continued movement of the slider 31, but the continued movement does reduce the amount of compression created as the back side defined by leg 31-4 of the slider 31 further uncovers flutes 21-4 which are thereby opened to suction. The complete movement is illustrated by that of slider 41.

The operation of the present invention will now be described in going from a full load to the least loaded setting. Initially, slider 31 will be in the position illustrated in FIGS. 3, 6, 7, 8 and 13. Slider 41 will be repositioned to a position corresponding to that of slider 31. In these positions, notch portions 31-2 and 31-3 of slider 31 and notch portions 41-2 and 41-3 of slider. 41 define part of the axial outlet ports 14-8 and 14-9, respectively, as grooves or flutes 21-4 containing trapped compressed gas come into registration therewith. Sliders 31 and 41 cover the maximum number of flutes 21-4 permitting the gas therein to be compressed as well as in the flutes 20-1 and 22-1 in fluid communication therewith as is best shown in FIGS. 13 and 14. Collectively, discharge end bearing case 14 and sliders 31 and 41 provide complete registration with labyrinth seal 21-1 such that cavity 16 is fluidly isolated from recesses 14-4*b* and 14-5*b*. In these positions of sliders 31 and 41, cavity 16 and recesses 14-4*b* and 14-5*b* are at suction pressure. Only recesses 14-4*a* and 14-5*a* are at discharge pressure and, as best shown in FIG. 12, this is of minor consequence due to the relatively small dimensions of recesses 14-4*a* and 14-5*a* and valve portions 31-1 and 41-1 exposed thereto.

Although valves 30 and 40 can be moved independently, they will normally be in about the same relative positions in order to balance the forces acting on the rotors. As slider 31 moves from its FIG. 3 position towards the left or repositioned slider 41 moves towards its position in FIG. 3, they restrict the outlet ports 14-8 and 14-9 as the notch portions 31-2 and 31-3 of slider 31 and notch portions 41-2 and 41-3 of slider 41 go out of registration with outlet ports 14-8 and 14-9. Movement of sliders 31 and 41 initially reduces the size of the axial porting followed by the closing of the axial discharge passages 14-8 and 14-9 to the minimum $V_i$ required for good unit performances. This has the result of changing the $V_i$ of the unit which affects the efficiency of unit performance. Additionally, sliders 31 and 41 go out of registration with labyrinth seal 21-1 and uncover flutes 21-4 allowing grooves or flutes 21-4 to communicate via chambers 14-4*b* or 14-5*b* with chamber 16 and axial bores 21-2 to suction chamber 12-6 thereby delaying the trapping and starting of compression in the grooves or flutes 21-4 and the grooves or flutes 20-1 on rotor 20 and the grooves or flutes 22-1 on rotor 22 which are in fluid communication therewith.

When slider 41 is moved to its position of FIGS. 3, 6, 7, 8, 11 and 14 and slider 31 is moved to a corresponding position, outlet ports 14-8 and 14-9 will be blocked by sliders 31 and 41, respectively. However, as is clear from FIG. 3, radial discharge ports 12-4 and 12-5 do not coact with sliders 31 and 41, respectively, and permit the discharge of compressed gas but the degree of compression will be reflected by the bypass to suction via chamber 16 permitted by sliders 31 and 41, respectively. Additionally, flutes 21-4 will have the least amount of coverage by sliders 31 and 41 such that the minimum volume will be available for compression.

Although a preferred embodiment of the present invention has been illustrated and described, other changes will occur to those skilled in the art. For example, the description has been specific to a tri-rotor compressor but would be applicable to multi-rotor configuration. It is therefore intended that the scope of the present invention is to be limited only by the scope of the appended claims.

What is claimed is:

1. In a multi-rotor screw machine having a rotor housing and a discharge housing secured to said rotor housing, a plurality of rotors located in said rotor housing with one of said rotors being a sun rotor having an axis of rotation and driving and coacting with each of the other plurality of rotors in a paired relationship with each pair having an axial and a radial discharge, structure for unloading and controlling capacity in said screw machine comprising:

said sun rotor having an end facing said discharge housing;

an annular seal located on said end of said sun rotor in a sealing relationship with said discharge housing;

said seal extending axially further towards said discharge housing than a portion of said end radially inward of said seal and at least partially forming a low pressure chamber;

a fluid path connecting said chamber to suction pressure in said screw machine;

a pair of recesses formed in said discharge housing and each of said recesses being partially coextensive with said end of said sun rotor and said seal;

a pair of slide valves with each of said slide valves having a slider reciprocatable in a corresponding one of said recesses;

means for individually selectively moving said slide valves in said recesses;

each of said slide valves having a full load position wherein said sliders and said discharge housing form a full 360° sealing relationship with said annular seal and form a part of the corresponding axial discharge; and when said slide valves move from their full load position they restrict said axial discharge and permit fluid communication across said seal to cause unloading and to delay the start of compression with the positions of said slide valves determining the degree of restriction of said axial discharge and the degree of delaying the start of compression.

2. The structure for unloading and controlling capacity of claim 1 further including:

said sun rotor having a plurality of circumferentially spaced helical flutes;

each of said slide valves selectively covering and uncovering a varying amount of said flutes as said slide valves are moved;

each of said sliders including a valve portion;

each of said pair of recesses having a first portion and a second portion defining a cavity said first portion receiving the corresponding one of said valve portions in a sealed relationship which seals said first portions from the corresponding ones of said second portion of said recesses; and said cavities providing fluid communication between uncovered flutes and said low pressure chamber when corresponding ones of said slide valves move from their full load position.

3. In a multi-rotor screw machine having a rotor housing and a discharge housing secured to said rotor housing, a plurality of pairs of overlapping bores having parallel axes located in said rotor housing, a rotor located in each of said bores, a sun rotor being one of each pair of rotors in overlapping bores and having an axis of rotation coaxial with the axis of the corresponding bore, said sun rotor driving each of the others one of said pairs of rotors with each pair of rotors having an axial and a radial discharge, structure for unloading and controlling capacity in said screw machine comprising:

each pair of overlapping bores defining a pair of cusps with said radial discharge for each pair of rotors being located in one of the corresponding pair of cusps and always being open;

said sun rotor having an end facing said discharge housing;

an annular seal located on said end of said sun rotor in a sealing relationship with said discharge housing;

said seal extending axially further towards said discharge housing than a portion of said end radially inward of said seal and at least partially forming a low pressure chamber;

a fluid path connecting said chamber to suction pressure in said screw machine;

a pair of recesses formed in said discharge housing and each of said recesses being partially coextensive with said end of said sun rotor and said seal;

a pair of slide valves with each of said slide valves having a slider reciprocatable in a corresponding one of said recesses;

means for individually selectively moving said slide valves in said recesses;

each of said slide valves having a full load position wherein said sliders and said discharge housing form a full 360° sealing relationship with said annular seal and form a part of the corresponding axial discharge; and when said slide valves move from their full load position they restrict said axial discharge and permit fluid communication across said seal to cause unloading and to delay the start of compression with the positions of said slide valves determining the degree of restriction of said axial discharge and the degree of delaying the start of compression.

4. The structure for unloading and controlling capacity of claim 3 further including:

said sun rotor having a plurality of circumferentially spaced helical flutes;

each of said slide valves selectively covering and uncovering a varying amount of said flutes as said slide valves are moved;

each of said sliders including a valve portion;

each of said pair of recesses having a first portion and a second portion defining a cavity said first portion receiving the corresponding one of said valve portions in a sealed relationship which seals said first portions from the corresponding ones of said second portion of said recesses; and said cavities providing fluid communication between uncovered flutes and said low pressure chamber when corresponding ones of said slide valves move from their full load position.

5. A method of unloading and controlling capacity in a multi-rotor screw machine having a suction chamber, a sun rotor having a plurality of flutes and coacting with a plurality of rotors in a paired relationship with each pair of rotors having an axial and a radial discharge comprising the steps of:

maintaining each of said radial discharges fully opened under all operating conditions:;

selectively blocking each of said axial discharges; and selectively uncovering and connecting said flutes of said sun rotor to suction to delay the start of compression and to thereby control capacity in said screw machine.

* * * * *